US011814865B1

(12) United States Patent
Wenke

(10) Patent No.: US 11,814,865 B1
(45) Date of Patent: Nov. 14, 2023

(54) POOL SPRING WRAP

(71) Applicant: JDSports WM, LLC, Edison, NJ (US)

(72) Inventor: Sean Wenke, Monmouth Junction, NJ (US)

(73) Assignee: JDSports WM, LLC, Edison, NJ (US)

( * ) Notice: Subject to any disclaimer, the term of this patent is extended or adjusted under 35 U.S.C. 154(b) by 0 days.

(21) Appl. No.: 18/085,931

(22) Filed: Dec. 21, 2022

(51) Int. Cl.
*E04H 4/10* (2006.01)

(52) U.S. Cl.
CPC ..... *E04H 4/10* (2013.01)

(58) Field of Classification Search
CPC . A47C 23/12–155; A47D 13/107; A63B 5/11; B60R 2022/006; E04H 4/10–108; E04H 4/143; F16F 2238/026–028; Y10S 16/36
USPC ..... 150/154–165; 4/503
See application file for complete search history.

(56) References Cited

U.S. PATENT DOCUMENTS 1,616,133 A * 2/1927 Lowy ..... A47C 23/155 267/74
2,958,872 A * 11/1960 Meyer, Jr. ..... E04H 4/10 5/199
3,860,226 A * 1/1975 Hensiek, Jr. ..... F16F 1/128 267/69
5,131,450 A * 7/1992 Lichy ..... E04H 4/101 160/310
5,876,311 A * 3/1999 Coates ..... A47C 9/002 297/274
8,733,789 B1 * 5/2014 Kinnear ..... B60R 22/00 280/733
9,027,174 B2 * 5/2015 Marelli ..... F16F 1/06 4/503
9,353,540 B2 * 5/2016 Jennings ..... E04H 4/103
9,624,997 B2 4/2017 Marelli

FOREIGN PATENT DOCUMENTS

GB 2220344 * 1/1990 ..... B60R 22/00

OTHER PUBLICATIONS

Lunpliran Sleeves for Pool Safety Cover Springs. Amazon. Accessed Jun. 29, 2023. <https://www.amazon.com/Lunpliran-Sleeves-Reusable-Protective-Included/dp/B0BK628R2H>. (Year: 2023).*

(Continued)

*Primary Examiner* — David P Angwin
*Assistant Examiner* — Nicholas A Ros
(74) *Attorney, Agent, or Firm* — Sheppard Mullin Richter & Hampton LLP

(57) ABSTRACT

A pool cover spring wrap is described. The pool cover spring wrap can comprise a substantially rectangular member having two sides and a fastener. Various types of fasteners may be used. In some embodiments, the fastener comprises a first fastener element and a second fastener element. When the first fastener element is engaged with the second fastener element, the rectangular member forms an encircling member having a first opening on a first end of the encircling member and a second opening on a second end of the encircling member remote from the first opening. The pool cover spring wrap can be wrapped around the spring coil and the faster elements can be attached to affix the wrap to the spring.

9 Claims, 11 Drawing Sheets

(56) References Cited

OTHER PUBLICATIONS

"WBCBEC 12PCS Sleeves for Pool Safety Cover Springs, Pool Cover Spring Sleeves, Reusable Protective Spring Cover, Spring Sleeves for Winter Safety Pool Covers, Springs Not Included", available on the Internet at <URL: https://www.amazon.com/WBCBEC-Sleeves-Reusable-Protective-Included/dp/B0BFPVL1H5>, printed on Nov. 14, 2022, 10 pages.

* cited by examiner

POOL SPRING WRAP

BACKGROUND

Pools offer hours of enjoyment and are widely incorporated with entertainment areas in homes and businesses. When pools are not in use (e.g., closed during an off-season), they are often protected by a pool cover. The pool cover can be constructed from a sturdy tarp, vinyl or other material that prevents the water in the pool from being accessed by people or nature.

It is known to connect the pool cover to a pool deck or surrounding area using springs as shown for example in U.S. Pat. No. 9,624,997 entitled "POOL SPRING COVER" which is incorporated herein by reference in its entirety. One end of the spring can engage with the pool cover and the other end of the spring can engage with posts or other fastener elements that are drilled or otherwise embedded into or secured to the pool deck or surrounding area. However, since these springs often lay on the pool deck, interaction with these springs can cause contusion-type injuries to individuals who trip over the exposed/jagged metal springs. Also, exposed metal springs may harm the pool deck by rubbing and scratching it as the springs move or expand and contract with the weather. Friction (i.e., the rubbing and scratching) between the spring and the pool deck can also affect the integrity of the springs, causing a need for the springs to be replaced in order to maintain the protection of the pool by the pool cover.

Some springs are covered using pool spring tubes or sleeves such as element 200 in U.S. Pat. No. 9,624,997. Some pool cover systems use a plastic sleeve that is slid over the spring before it is connected to the cover and posts. Each pool spring tube or sleeve can slide on and off the spring. To cover the spring, the pool spring tube or sleeve is pushed over the top of the spring into place. However, pushing the tube or sleeve over the spring can be cumbersome. For example, the pool spring tube or sleeve is often constructed using less expensive vinyl material which may be too tight or too loose. The material also can be damaged in inclement weather and standard use. During harsh weather conditions, the pool spring tubes or sleeves expand and/or contract. Expansion can cause a loose fit and contraction can cause cracking. If the spring is warped, the pool spring tube or sleeve can be hard to maneuver on. Additionally, the spring needs to be detached from the pool cover and/or pool deck in order to slide the tube or sleeve on or off the spring. Other problems exist.

SUMMARY

In this disclosure, a pool spring wrap is described. The pool spring wrap can comprise a substantially rectangular member having two opposing surfaces (e.g., a top surface and a bottom surface) and a fastener. The rectangular member may be defined by two pairs of substantially parallel edges. Other shapes may be used.

Various types of fasteners may be used. In some embodiments, the fastener comprises a first fastener element and a second fastener element. When the first fastener element is engaged with the second fastener element, the rectangular member forms an encircling member having a first opening on a first end of the encircling member and a second opening on a second end of the encircling member remote from the first opening. The wrap can be wrapped around the spring and the faster elements can be attached to affix the wrap to the spring. The spring can hold the pool cover with tension to keep it in place. As detailed below, the spring wrap has various advantages over the previously used plastic spring sleeves.

The size of the pool spring wrap may substantially correspond with the size of coils of a pool spring. For example, the length of the pool spring wrap can be relatively the same size as the length of the coil of a pool spring (e.g., covering the pool spring coil and absent the spring rings). The size of the pool spring wrap may substantially cover the spring coil. Other relative dimensions of the wrap and spring element(s) can be used.

The pool spring wrap may comprise a substantially rectangular member that is constructed of a durable material that may include, for example, a vinyl coated polyester. The material may be UV resistant. The material may be substantially the same as the material of the pool cover that is a strong, flexible, water-resistant or waterproof material. Some illustrative, non-limiting examples of the material can include a tarpaulin or "tarp" material, canvas, polyester coated with polyurethane, or polyurethane itself. In some embodiments, the material is fabricated to be substantially resistant to expansion or contraction to avoid cracking or other failure such as is common with the plastic sleeves that are currently used.

The edges that surround the perimeter of the pool spring wrap may be protected to prevent fraying or getting damaged. For example, as alluded to above the rectangular member may be coated in vinyl or similar protective materials to effectively seal the edges that surround the perimeter of the pool spring wrap. Alternatively, or in addition to the above-described coating/sealing, fabric (e.g., polyester fabric) may be attached/sewn around the perimeter of the pool spring wrap to better protect the edges of the pool spring wrap. The polyester fabric may comprise a generic polyester material without additional treatment during the manufacturing and assembly process. Other types of sealing/protective processes may be implemented without diverting from the essence of the disclosure.

In some examples, the durable material for the wrap may be treated and processed to help improve the durability of the pool spring wrap and further prevent tears and damage to the pool spring wrap, creating a rectangular member that is constructed of a vinyl coated polyester and covered with a coating (e.g., another vinyl material). For example, the tarpaulin material may be coated by a process called knife coating using a coating material, as further illustrated herein.

One or more fasteners can be added to edges of the durable material of the pool spring wrap. The fastener can comprise a first fastener element and a second fastener element. The fastener can be constructed of a material to fasten the fastener elements to each other and form the encircling member. The fastener elements may be sewn to, adhered or otherwise connected to opposing edges of the wrap. The encircling member may have a first opening on a first end of the encircling member and a second opening on a second end of the encircling member remote from the first opening. For example, the fastener may be constructed of a hook and loop material such as Velcro™material. The fastener may be used to fasten the pool spring wrap tightly into place around the spring as the two fastener ends are engaged with each other. In some embodiments, the first fastener element may be connected to an edge on the first surface of the wrap and the second fastener element may be connected to an opposing edge on the second surface of the wrap.

Unlike the pool spring tubes or sleeves, the pool spring wrap disclosed herein can be wrapped around a spring that is already attached at one end to a pool cover and at the other end to the posts of the spring anchors that connect the pool cover to the pool deck. This enables the wrap to be added after the spring is already so connected and to be replaced, if necessary, without disconnecting the spring. Often, the tension needed on the spring is such that average homeowners cannot easily connect, disconnect and reconnect the spring on their own.

Additional improvements to traditional pool spring covers are described throughout the disclosure, including improvements to standard pool spring tubes or sleeves. From a functional standpoint, the pool spring wrap and the pool spring tubes or sleeves are placed on the pool spring differently. The pool spring tubes or sleeves are slid over the top of the spring into place, which can be cumbersome. For a plastic tube to remain in place there typically needs to be a friction fit which can make it difficult to slide onto the spring. If the tube is slightly too small or contracts, this can make it very difficult to slide onto or off of the spring. If it is slightly too large or expands, it may not remain firmly in place on the spring coil. This requires more precise manufacturing tolerances and even then, is subject to problems if the plastic expands or contracts. In contrast, these problems are avoided by the design and operation of the pool spring wraps which are placed on the spring by wrapping it around the spring and engaging the fastener elements. Due to the nature of the material used for the wrap, expansion and contraction are not as likely and even if it occurs it avoids the problems experienced by the friction for plastic tubes.

In another example, the pool spring wrap can be placed on the pool spring after the spring is installed with the pool cover, whereas pool spring tubes or sleeves cannot be placed on the pool spring after the spring is installed with the pool cover. If someone wanted to add or replace pool spring tubes or sleeves to their pool spring after the pool cover has been installed, they would have to remove the spring, which is generally a labor intensive process and not done by an average homeowner. The same deconstruction of the pool cover is not required with the pool spring wrap, since the pool spring wrap can easily be taken on and off after the pool cover is installed over the pool, yet still provide protection for the pool spring and pool deck.

In another example, the fastener elements of the pool spring wrap can be constructed on two (opposing) surfaces of the pool spring wrap (e.g., the top surface of the pool spring wrap and the bottom surface of the pool spring wrap), allowing the user to flip over or otherwise turn the pool spring wrap inside-out and use either surface of the pool spring wrap as the portion of the wrap that faces outward toward the environment, as illustrated in the accompanying figures. Since two surfaces can be used, the pool spring wrap incorporates a reversible design allowing either of the two surfaces of the pool spring wrap to touch the spring and the other of the two surfaces of the pool spring wrap to touch the pool deck, whereas pool spring tubes or sleeves only allow one surface of use without a reversible design. This structural configuration provides a functional advantage and an aesthetic one. Functionally, if the outer surface of the wrap is scratched, frayed or otherwise damaged, the wrap can be reversed so that the other surface can be outwardly facing. This protects the structural integrity of the wrap material. It also enables a user to easily reverse the wrap if any damage makes it unsightly. Additionally, the first surface of the wrap can be made of a first color and the second surface a second color so that the pool owner can decide which color to display for aesthetic purposes. For example, one of the colors may be the same as the color of a pool cover with which the wrap is to be used to that they match. A second color may be a coordinating, but contrasting color to produce a different visual look. Cosmetically, the pool spring wrap may also be more attractive than standard pool spring tubes or sleeves. Since the same material may be used to construct the pool spring wrap and the pool cover, the separate pool cover components may have a uniform look and feel that may not fade over time. Various colors may be implemented (e.g., blue, green, etc.).

In contrast, the known pool spring tubes or sleeves are constructed such that there is only one way to use them (i.e., they are not reversible). When the outer surface of the pool spring tube or sleeve is damaged in inclement weather or standard use, the entire pool spring tube or sleeve becomes unusable or unsightly.

In another example, the material used in constructing standard pool spring tubes or sleeves is not weather resistant. During harsh weather conditions, the pool spring tubes or sleeves will begin to contract and/or crack with freezing temperatures and may expand in the heat. After one use, the pool spring tubes or sleeves may be stretched (in heat) or contracted and cracked (in freezing temperatures) so they do not have a tight fit (e.g., year-over-year). Comparatively, the pool spring wrap may be constructed using vinyl coated polyester or other similar material that is used to build pool covers. After continued use, the pool spring wrap can maintain a tight fit that is reusable. Moreover, even if the material slightly expands or contracts, this is mitigated since the wrap can be wrapped tighter or looser as necessary.

The surfaces of the pool spring wrap may have different textures as well, for example, a first surface being a matte design and a second surface being a textured or glossy design.

As discussed herein, the pool spring wrap can be used on both surfaces to protect the pool spring and pool deck. Each surface can be constructed of a different texture and finish to give it a different look. For example, one surface of the pool spring wrap can be constructed with a solid matte finish whereas the other surface of the pool spring wrap can have a glossier finish with a textured look. In comparison to standard pool spring tubes or sleeves, less flexibility in materials are available. The pool spring tubes or sleeves can crack, get dirty, smell and generally do not last very long. Also, the user is unable to remove or add the pool cover once the safety cover is already installed.

In some examples, the pool spring wrap can include more than one pool spring wrap (e.g., five blue pool spring wraps).

BRIEF DESCRIPTION OF THE DRAWINGS

The present disclosure, in accordance with one or more various embodiments, is described in detail with reference to the following figures. The figures are provided for purposes of illustration only and merely depict typical or example embodiments.

The figures are not exhaustive and do not limit the present disclosure to the precise form disclosed.

DETAILED DESCRIPTION

Figure 1:
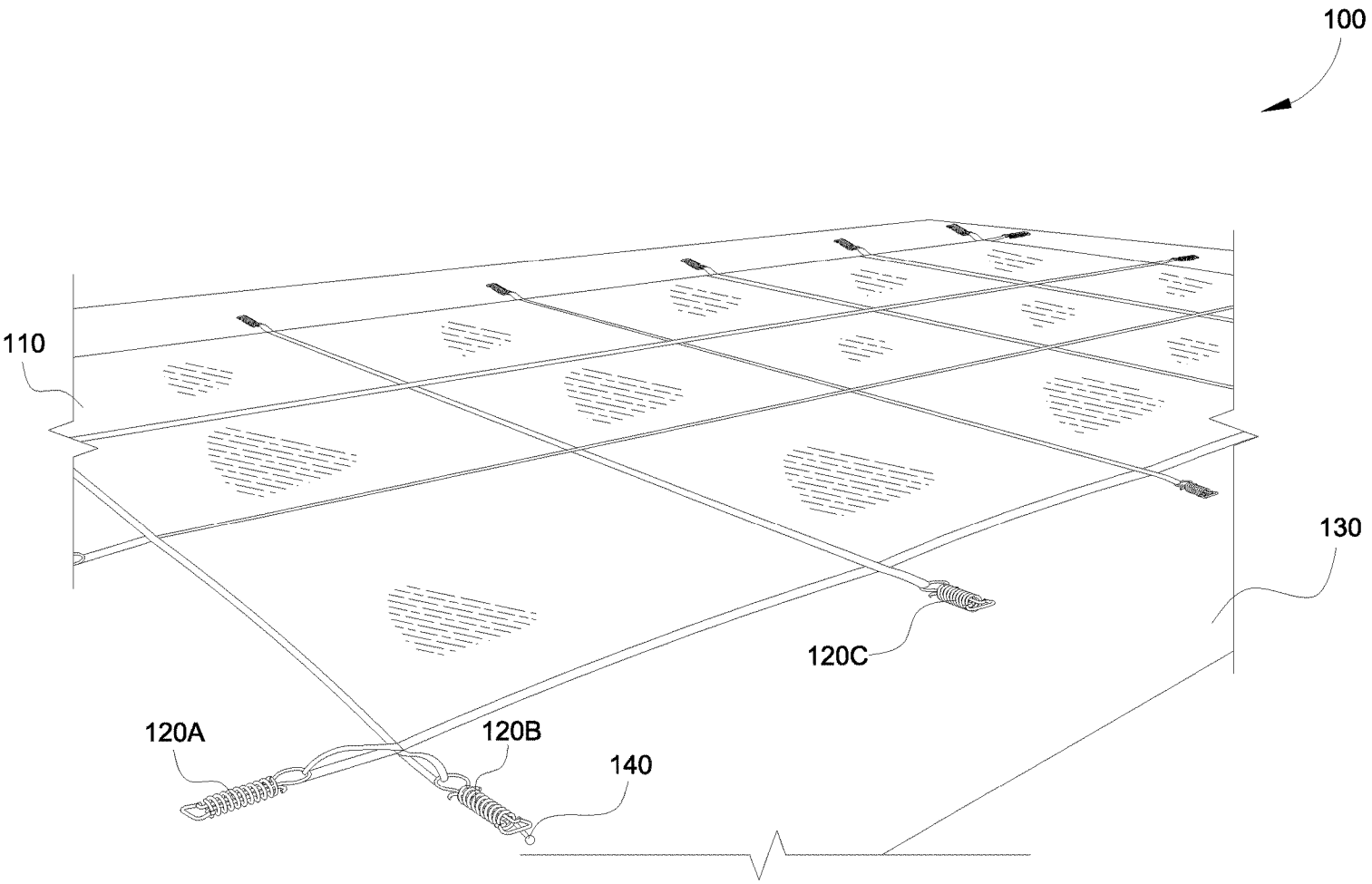
(PRIOR ART) FIG. 1
FIG. 1 illustrates a traditional pool deck, pool cover over a pool, and pool springs.
Figure 2:
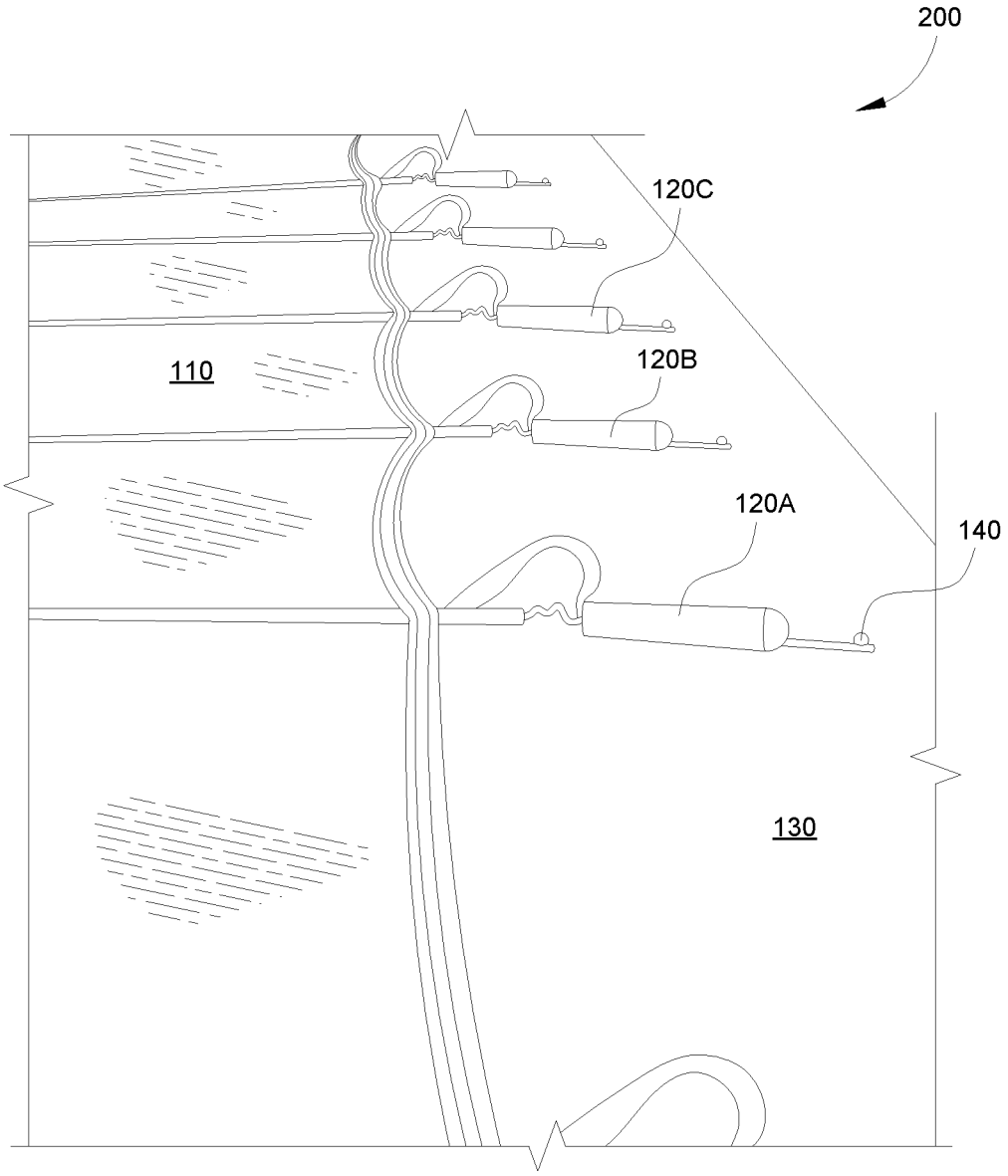
(PRIOR ART) FIG. 2
FIG. 2 illustrates a traditional set of springs with a pool spring tube or sleeve on each spring.

FIGS. 1 and 2 illustrate traditional pool covers, pool decks, pool springs, and pool spring tubes or sleeves. An example illustration of the pool spring wrap to incorporate with the traditional pool covers, pool decks, and pool springs is shown in FIGS. 3-6.

FIG. 1 illustrates a pool deck, pool cover over a pool, springs, and pool spring tubes or sleeves that fit over the pool springs. In illustration 100, pool cover 110, pool springs each with a pool spring tube or sleeve 120 (illustrated as first pool spring tube or sleeve 120A, second pool spring tube or sleeve 120B, and third pool spring tube or sleeve 120C), and pool deck 130 are shown. Pool cover 110 can be constructed from a sturdy tarp or vinyl material that prevents the water in the pool from being accessed by people or nature. The perimeter edges of pool cover 110 can include straps that extend over the edge of pool cover 110 and past the perimeter edge of the pool underneath (not shown). The straps of pool cover 110 may be affixed to one end of a pool spring with the other end of pool spring being attached to a connector 140, which is attached to a pool deck 130. Each of the pool springs may be covered by pool spring tube or sleeve 120.

Figure 3:
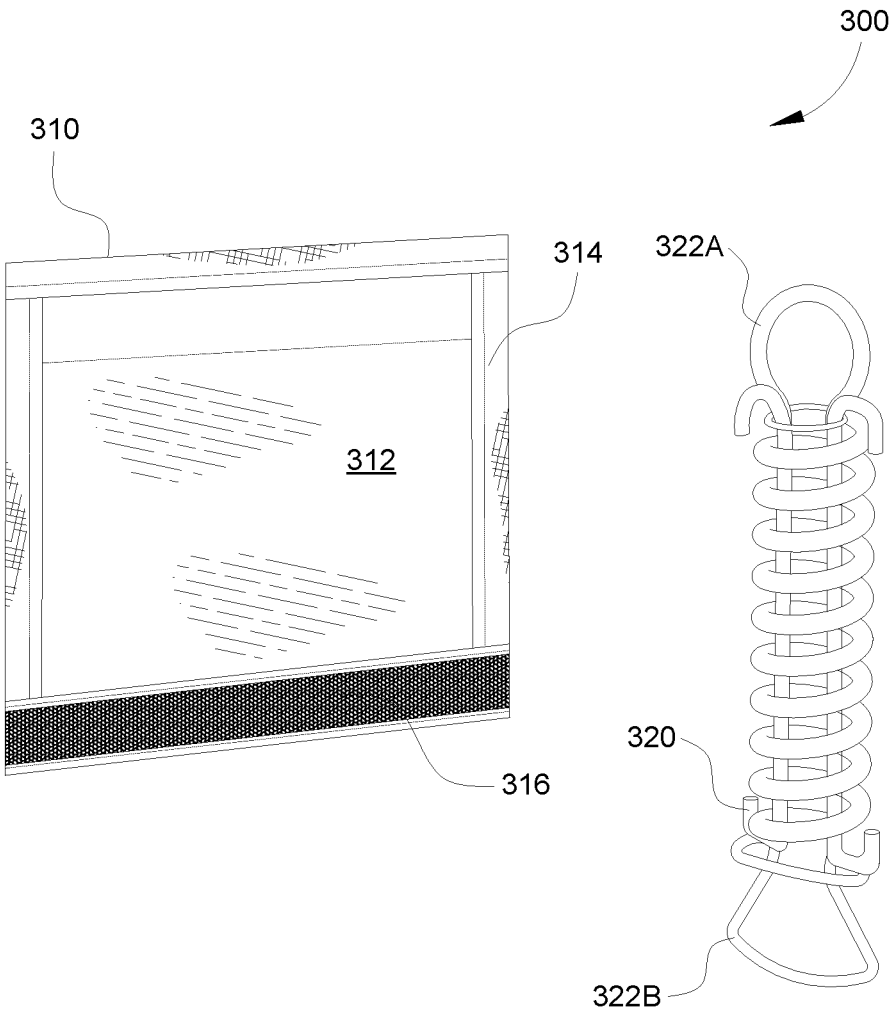
FIG. 3 illustrates a spring and a pool spring wrap, in accordance with some embodiments of the disclosure.

Each pool spring may include a pool spring coil and two spring rings, one at each end of the coil. The pool spring can affix to the edges of pool cover 110 through one of the spring rings of the pool spring. For example, for each of the straps at the edges of pool cover 110, one strap can be tied or otherwise coupled with one of the rings of the pool spring. With the strap and ring coupled, the spring coil that is connected to the spring ring is pulled (e.g., using tension) to tighten the perimeter edges of the pool cover 110. The other end of the spring coil is attached to a second ring. That end of the spring ring is tied or otherwise coupled with a connector 140 attached to the pool deck 130. This allows the pool cover 110 to connect to the pool spring, which connects to the connector 140 of the pool deck 130. Additional detail of a traditional pool spring is shown in FIG. 3 adjacent to the novel pool spring wrap.

FIG. 2 illustrates a traditional set of springs with a pool spring tube or sleeve on each spring. In illustration 200, additional detail is provided for a set of pool springs each with a pool spring tube or sleeve 120. The edges of pool cover 110 include straps that extend over the edge of pool cover 110. The straps of pool cover 110 may be affixed to one end of a pool spring (e.g., via a first spring ring) with the other end of pool spring being attached to pool deck 130 (e.g., via a second spring ring). Each of the pool springs may be covered by pool spring tube or sleeve 120.

Each of the pool spring tubes or sleeves 120 can be placed around a pool spring that is attached to pool cover 110 while the spring anchors the pool cover to the pool deck 130. The set of springs can pull different portions of pool cover 110 so the pool cover is tightly covering the pool underneath. This tension can create a stronger barrier that can prevent larger objects from entering the pool. The set of springs can hold the pool cover with tension to keep it in place.

Additional information associated with the traditional pool deck, pool cover over a pool, springs, and spring tubes or sleeves can be found in U.S. Pat. Nos. 2,958,872 and 9,027,174, each of which are incorporated herein by reference in their entirety.

FIG. 3 illustrates a replacement for the pool spring tubes or sleeves with the pool spring wrap, including an illustrative spring and a pool spring wrap, in accordance with some embodiments of the disclosure. In illustration 300, pool spring wrap 310 and spring 320 are provided. Pool spring wrap 310 comprises a substantially rectangular member 312 having first surface (shown), second surface (not shown), wrap perimeter 314, and fastener 316. Fastener 316 comprises a first fastener element (shown) and a second fastener element (not shown). The two surfaces of pool spring wrap 310 and the two fasteners 316 are illustrated in adjacent figures in FIG. 4.

Figure 4:
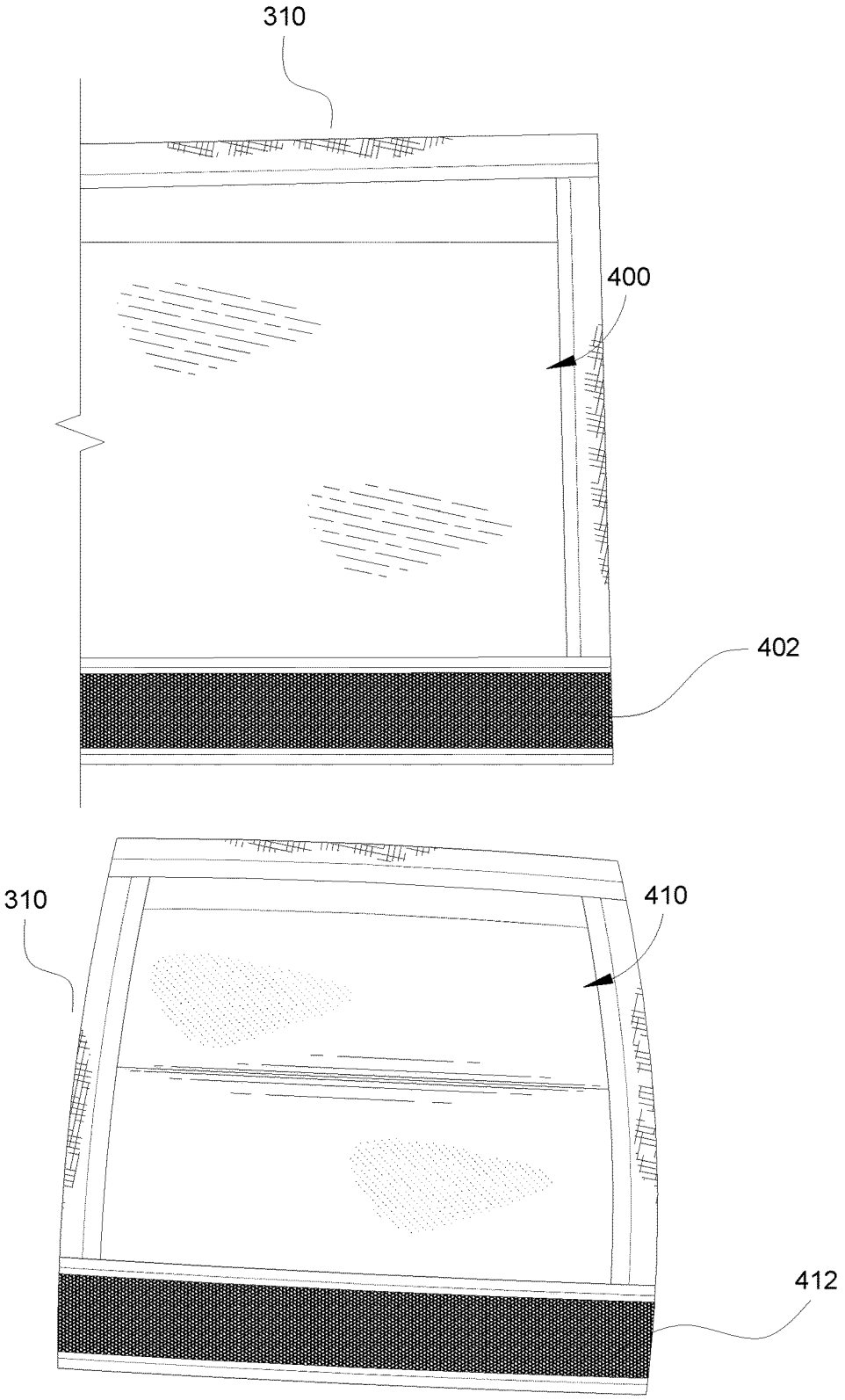
FIG. 4 illustrates two surfaces of a pool spring wrap, in accordance with some embodiments of the disclosure.

FIG. 4 illustrates two surfaces of pool spring wrap 310, in accordance with some embodiments of the disclosure. One surface of pool spring wrap 310 may alternatively face outward toward the environment, allowing each surface to individually face the environment at a time. As illustrated, pool spring wrap 310 may include a first surface 400 and a second surface 410 of a rectangular member that is constructed of a durable material with a fastener on each surface, including a first fastener element 402 on first surface 400 and a second fastener element 412 on second surface 410. When the first fastener element 402 is engaged with the second fastener element 412, the rectangular member forms an encircling member (e.g., an encircling member encircling a pool spring coil) having a first opening on a first end of the encircling member and a second opening on a second end of the rectangular member remote from the first opening.

In some examples, first surface 400 and second surface 410 are reversible so that the pool spring wrap can permit use from either surface to face outward. The user can flip over or otherwise turn around the pool spring wrap to use either surface outward toward the environment. The surfaces of the pool spring wrap may have different textures as well, for example, a first surface 400 being a matte design and a second surface being a textured or glossy design 410.

In some examples, the material used to construct the pool spring wrap 310 and the pool cover may be the same so that the separate pool cover components may have a uniform look and feel. Various colors may be implemented (e.g., blue, green, etc.).

As discussed herein, the pool spring wrap can be used on both surfaces to protect the pool spring and pool deck. Each surface can be constructed of a different texture and finish to give it a different look.

Figure 5:
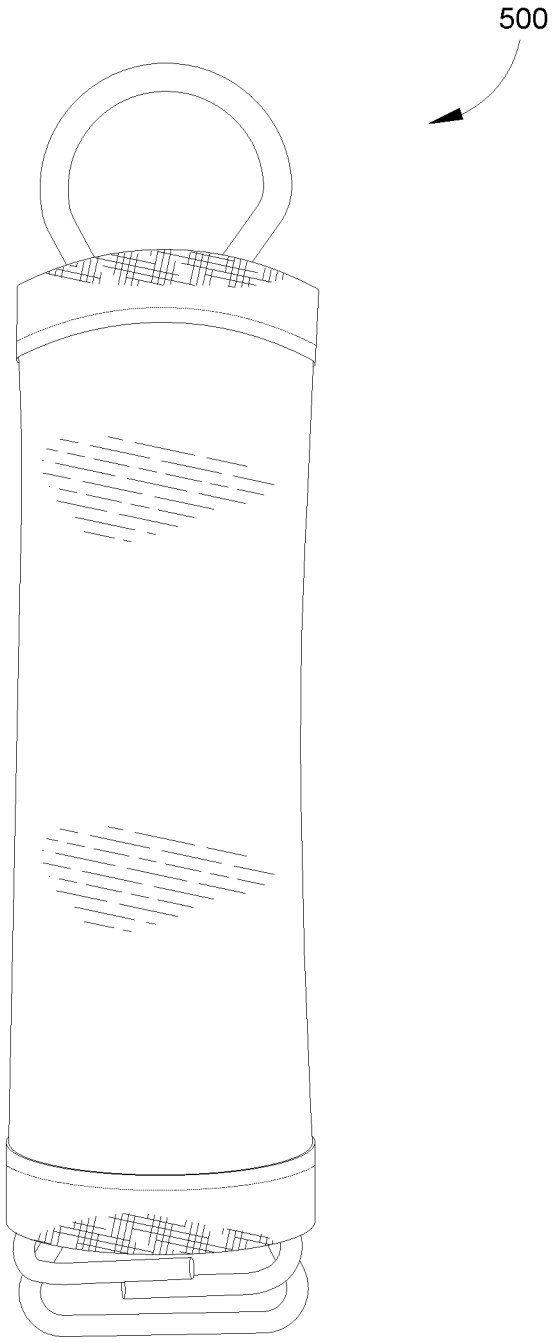
FIG. 5 illustrates a top-view of a spring and a pool spring wrap, in accordance with some embodiments of the disclosure.
Figure 6:
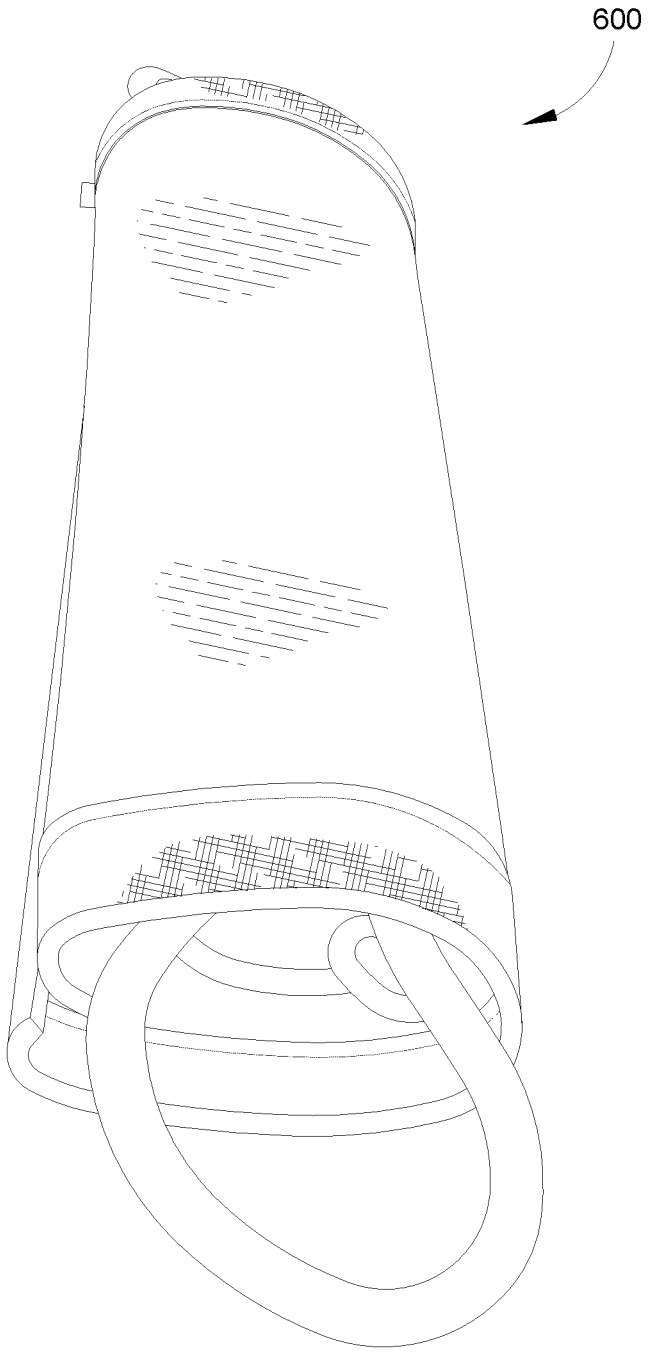
FIG. 6 illustrates a side-view of a spring and a pool spring wrap, in accordance with some embodiments of the disclosure.

Returning to FIG. 3, the size of pool spring wrap 310 may substantially correspond with the size of the coil of the spring 320 absent cover the spring rings 322 (illustrated as first spring ring 322A and second spring ring 322B). In some examples, the pool spring wrap can be relatively the same size as the coil of the pool spring 320 (e.g., covering the pool spring coil and absent covering the spring rings of the pool spring 320). The size of pool spring wrap 310 may substantially cover the spring coil of a standard sized pool cover spring 320 without substantially covering the spring rings 322, as shown in FIG. 5 and FIG. 6.

As an illustrative example, if the coils of the pool spring 320 are five inches, the pool spring wrap 310 can measure approximately 5⅛ inches by 5¼ inches. In general the length of the wrap should equal to or greater than the length of the coils but less than the length of the length of the spring from ring to ring. The width of the pool spring should be at least sufficient to wrap around the coils once and up to multiple times (e.g., 1.5-3 times).

Pool spring wrap 310 may be constructed of a durable material that may include, for example, a vinyl coated polyester. In some examples, the pool spring wrap is made of premium PVC Tarpaulin material. It can withstand harsh winters and will be resistant to adverse weather conditions. Additional detail on the construction and manufacturing process is provided with FIGS. 7-11.

As alluded to above, the edges that surround the perimeter of pool spring wrap 310 may be protected to prevent the edges from fraying or getting damaged. For example, a polyester fabric may be attached/sewn around the edges of rectangular member 312 to form a protective padding for wrap perimeter 314 (in certain embodiments the protective padding/layer of polyester fabric may be attached/sewn to all four edges of wrap perimeter 314, while in other embodiments the protective padding/layer of polyester fabric may be attached/sewn to a subset of the edges of wrap perimeter 314). This protective padding/layer of polyester fabric can reinforce the edges of pool spring wrap 310 thereby adding to the durability of pool spring wrap 310 and preventing against tearing/fraying. The protective padding/layer of polyester fabric may comprise a generic polyester material without additional treatment during the manufacturing and assembly process. Alternatively, or in addition to the protective padding for wrap perimeter 314, rectangular member 312 may be coated in vinyl or similar protective materials in order to effectively seal the edges of rectangular member 312. In the absence of protective padding for wrap perimeter 314, such sealed edges may also protect against tearing/fraying.

In some examples, the durable materials of pool spring wrap 310 or wrap perimeter 314 may be different and/or treated to help improve the durability of the pool spring wrap overall. The treatment of the material(s) may help prevent tears and damage to the pool spring wrap. For example, the tarpaulin material may be coated by a process called knife coating as further illustrated herein. In knife coating, the coating (e.g., vinyl/another vinyl) may be dropped onto the tarpaulin material and evenly distributed as the material goes through a roller on a conveyor belt or other surface. This may add durability to the tarpaulin material as well as better water protection.

Fastener 316 can be constructed of a material that permits the fastener elements to be selectively fastened to each other (e.g., Velcro material) and form an encircling member. The encircling member may tightly wrap pool spring wrap 310 around spring 320 as the two fastener ends are engaged with each other. The encircling member may have a first opening on a first end of the encircling member and a second opening on a second end of the encircling member remote from the first opening, as illustrated in FIG. 5 and FIG. 6. Spring 320 can be placed inside the encircling member for added protection of the spring.

The first fastener element and the second fastener element of fastener 316 may be located within a proximity distance of wrap perimeter 314 of rectangular member 312. In some examples, the proximity distance may include touching the edge of the first fastener element of fastener 316 with one edge of wrap perimeter 314. In other examples, the proximity distance may be within an inch of the edge of wrap perimeter 314 or less.

Figure 7:
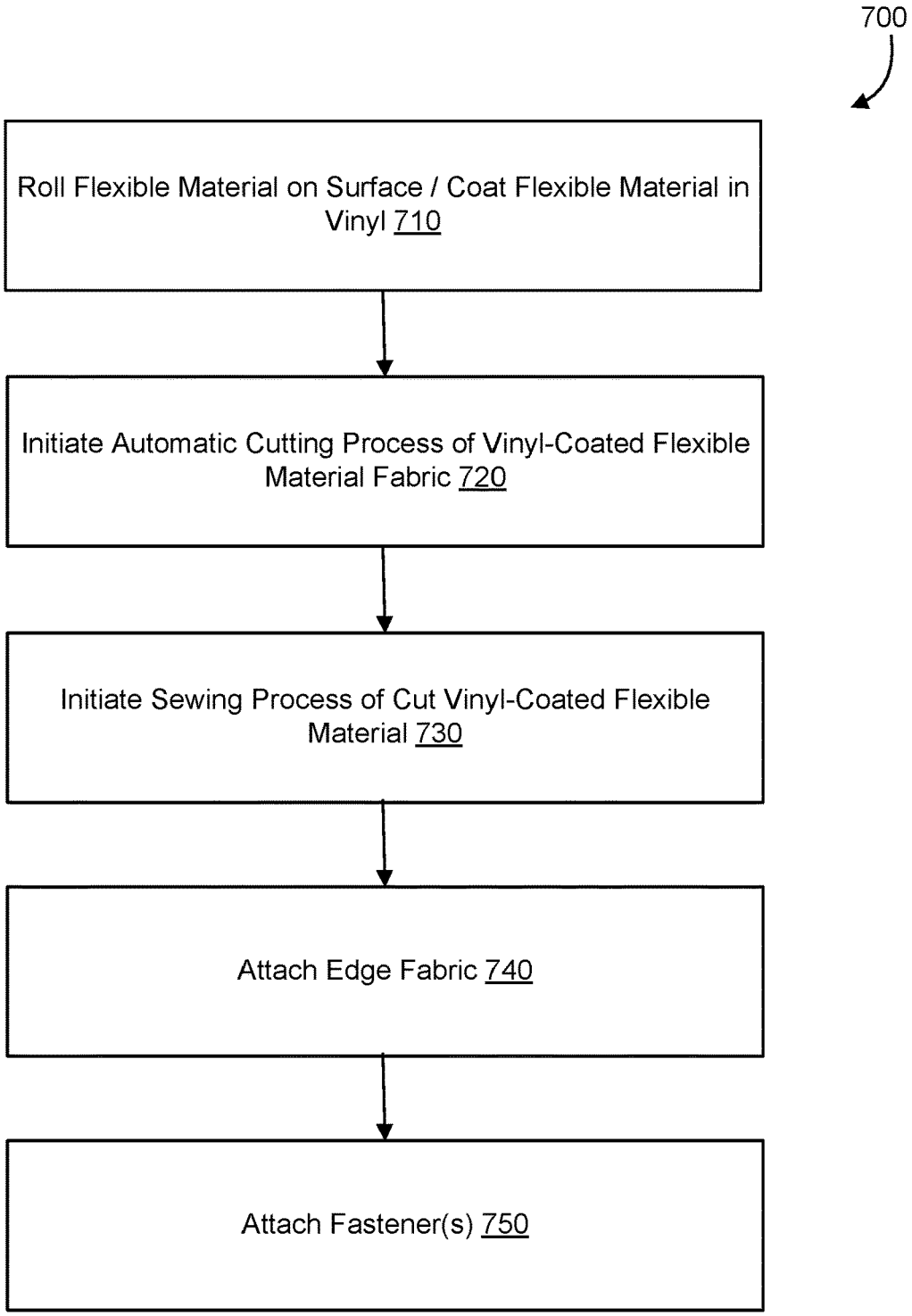
FIG. 7 provides an illustrative manufacturing process of the pool spring wrap, in accordance with some embodiments of the disclosure.
Figure 8:
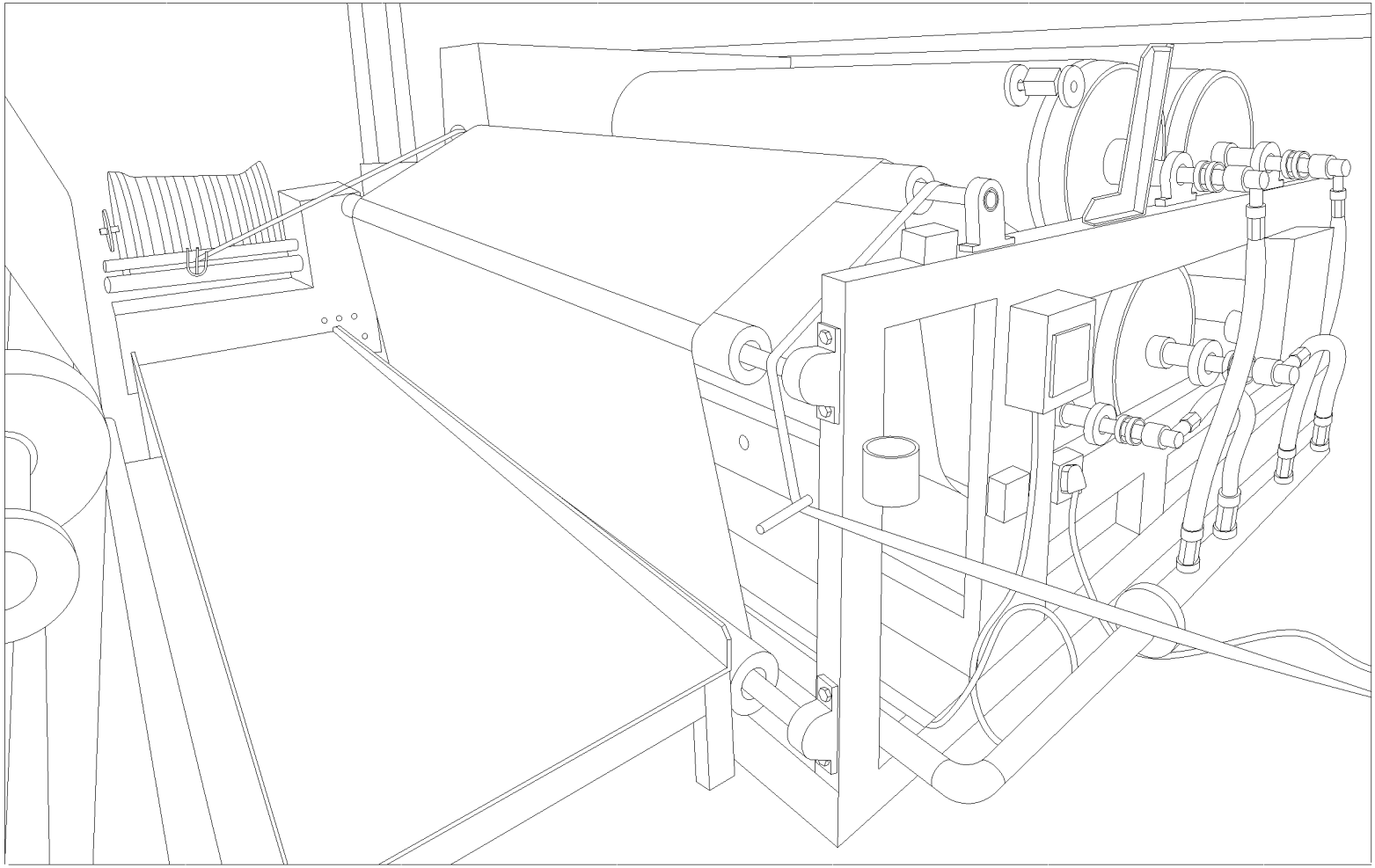
FIG. 8 provides an illustrative roll of polyester fabric on a surface, in accordance with some embodiments of the disclosure.
Figure 9:
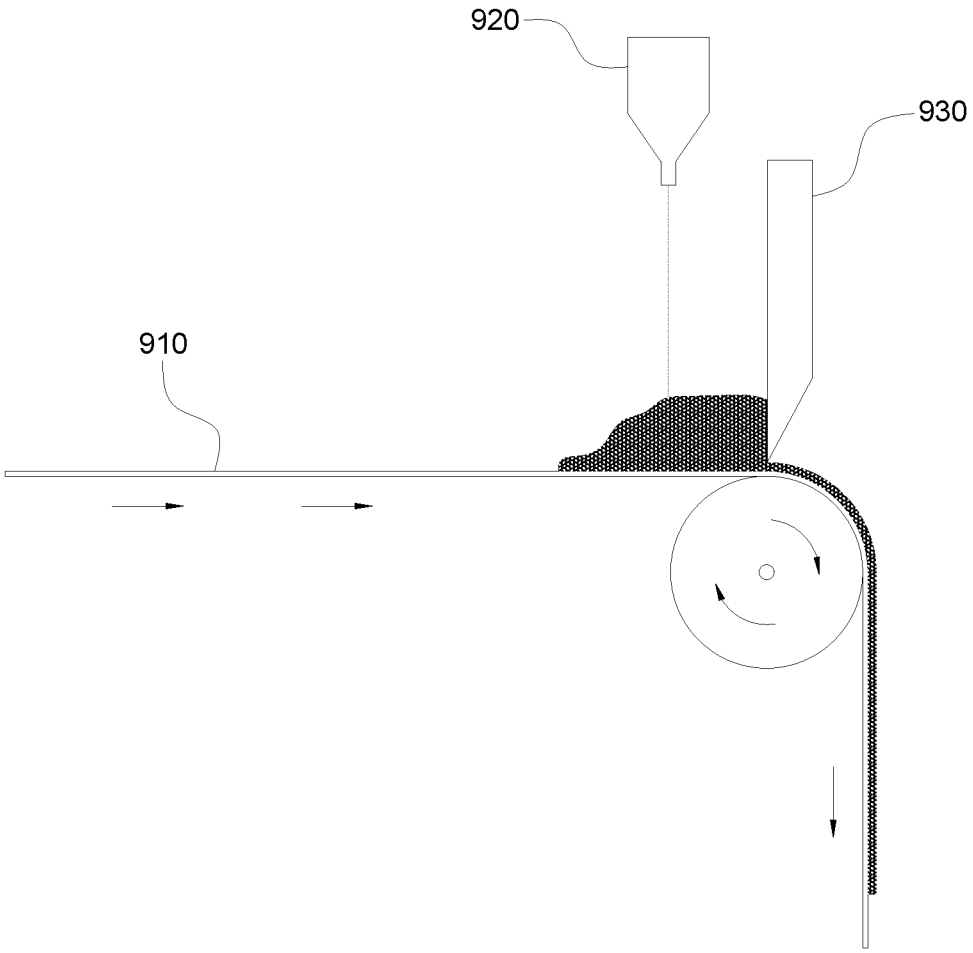
FIG. 9 provides an illustrative knife coating diagram, in accordance with some embodiments of the disclosure.
Figure 10:
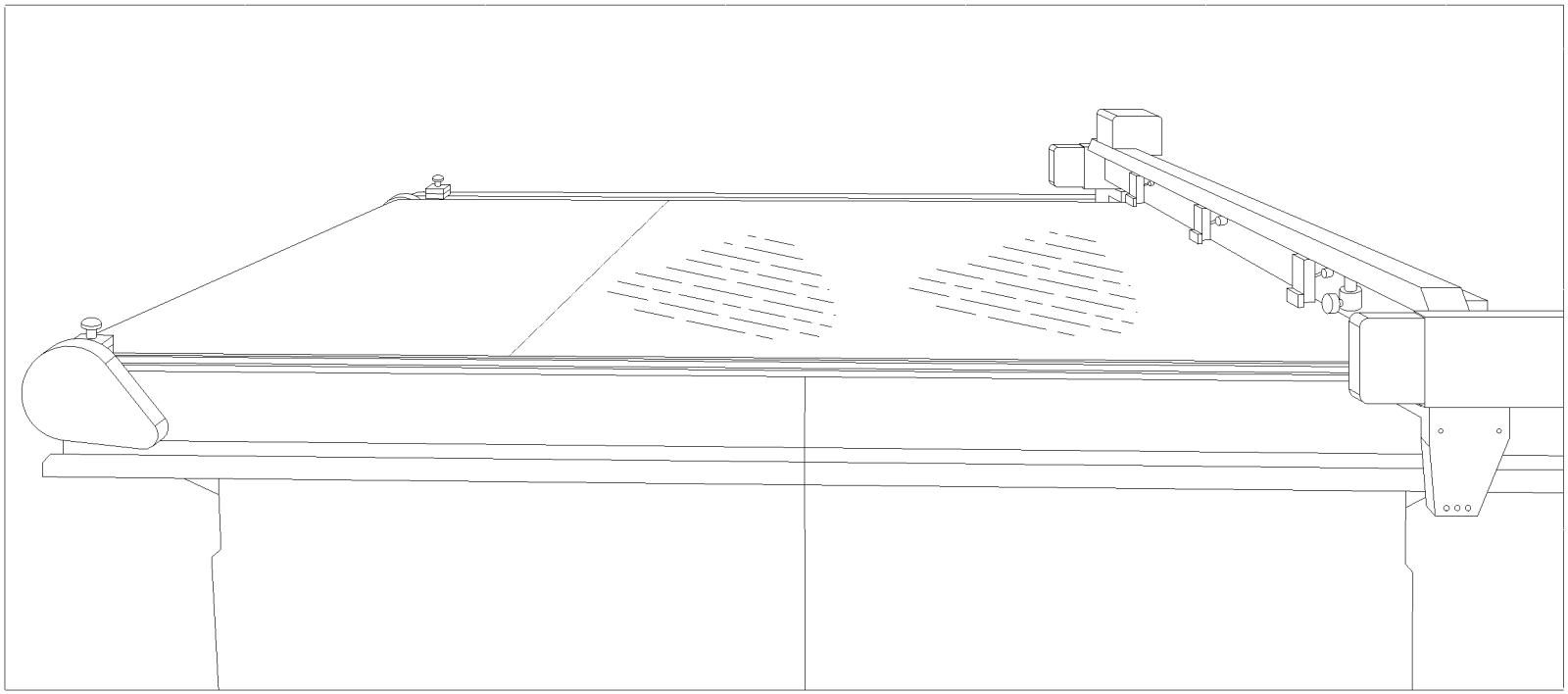
FIG. 10 provides an illustrative automatic cutting process, in accordance with some embodiments of the disclosure.
Figure 11:
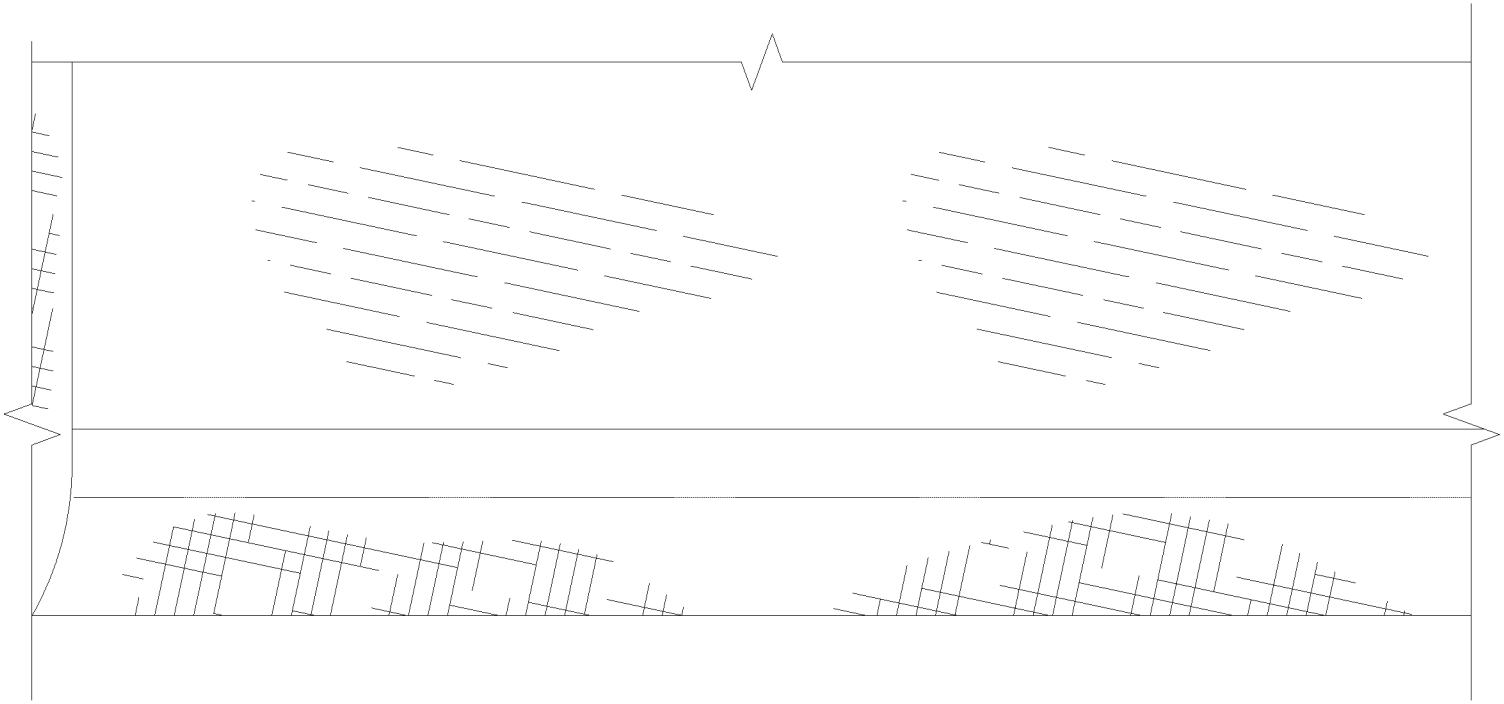
FIG. 11 provides illustrative padding and overlapping effect of the edge of the pool spring wrap, in accordance with some embodiments of the disclosure.

FIG. 7 provides an illustrative manufacturing process of the pool spring wrap, in accordance with some embodiments of the disclosure. In example 700, an illustrative manufacturing process of one or more pool spring wraps is provided.

At block 710, a flexible material may be rolled and placed on a surface. For example, the flexible material may be generated using an industrial machine and rolled into a giant roll of material. The flexible material may comprise any strong, flexible, water-resistant or waterproof material discussed herein, including a tarpaulin or "tarp" material, canvas, polyester coated with polyurethane, or polyurethane itself. An image of an illustrative roll of polyester on a surface is provided in FIG. 8.

In some examples, at least a first surface of the flexible material may be coated to create a vinyl-coated flexible material for the pool spring wrap. The coating may be implemented using a process called material coating or knife coating, where the coating may be dropped onto the first surface of the flexible material and evenly distributed as the flexible material goes through a roller. An illustrative material coating process is provided in FIG. 9. In this example, flexible material 910 is provided on a surface through a coating 920. An excess of coating 920 is applied to the first surface of flexible material 910 and removed by metering blade 930 (e.g., knife) to achieve the desired coating thickness. For example, metering blade 930 may be raised to a higher altitude away from the first surface of flexible material 910 as it passes on a surface in order to increase the amount of coating 920 that remains on the first surface of flexible material 910.

Returning to FIG. 7, at block 720, an automatic cutting process of the vinyl- coated flexible material may be initiated. For example, using a cutting machine (e.g., a fully automatic cutting machine), the vinyl-coated flexible material may be laid on a cutting table and cut to form a first rectangularly-cut vinyl-coated flexible material (where at least a first surface of the first rectangularly-cut vinyl-coated flexible material is vinyl-coated). A dynamic and specified size of the vinyl-coated flexible material may be provided as input to a computer associated with the cutting machine. The cutting machine may begin cutting the vinyl-coated flexible material using the knife incorporated with the cutting machine. An image of the illustrative cutting machine that implements the automatic cutting process is provided in FIG. 10.

At block 730, a sewing process may be initiated. For example, a sewing machine (e.g., a single stitch sewing machine) may be implemented that sews the first rectangularly-cut vinyl-coated flexible material to a second rectangularly-cut flexible material (this second rectangularly-cut flexible material may have been similarly produced and vinyl-coated via the processes of blocks 710-720, although this need not be the case). The first rectangularly-cut vinyl-coated flexible material may be sewn to the second rectangularly-cut flexible material such that a second surface of the first rectangularly-cut vinyl-coated flexible material faces a first surface of the second rectangularly-cut flexible material. The sewn-together rectangularly-cut flexible materials may be defined by a perimeter comprising two pairs of opposing edges.

In certain examples, prior to sewing the first rectangularly-cut vinyl-coated flexible material to the second rectangularly-cut flexible material, a padding fabric may be placed between the second surface of the first rectangularly-cut vinyl-coated flexible material and the first surface of the second rectangularly-cut flexible material. Accordingly, when the first rectangularly-cut vinyl-coated flexible material is sewn to the second rectangularly-cut flexible material the padding fabric may be encompassed between the second surface of the first rectangularly-cut vinyl-coated flexible material and the first surface of the second rectangularly-cut flexible material.

At block 740, an edge fabric (e.g., a polyester fabric) may be attached (e.g., sewn) around the perimeter of the sewn-together rectangularly-cut flexible materials. The edge fabric/padding may help prevent the edges of the pool spring wrap from fraying or getting damaged. An image of the edge fabric/padding, and overlapping effect of the pool spring wrap is provided in FIG. 11.

At block 750, one or more fastener elements may be attached. For example, a first fastener element may be attached to the first (vinyl-coated) surface of the first rectangularly-cut vinyl-coated flexible material proximate to one opposing edge of a first pair of the opposing edges of the sewn-together rectangularly-cut flexible materials. Conversely, a second fastener element may be attached to a second surface of the second rectangularly-cut flexible material proximate to a second opposing edge of the first pair of the opposing edges of the sewn-together rectangularly-cut flexible materials. An example image of the fasteners is provided in FIG. 4.

In some alternative embodiments, a set of pool spring wraps (e.g., hundreds) may be sewn together in the sewing process first, and then provided to the automatic cutting process second. This may cause blocks 710 and 720 to be switched in an ordered progression of generating a pool spring wrap. When this ordering is implemented, the cutting process may overlap edges of the flexible fabrics of the pool spring wrap during the automatic cutting process to eliminate fraying of the flexible material.

In certain alternative embodiments, instead of sewing the first rectangularly-cut vinyl-coated flexible material to the second rectangularly-cut flexible material, the pool spring wrap may be constructed using just the first rectangularly-cut vinyl-coated flexible material. Accordingly, the first fastener element may be attached to the first (vinyl-coated) surface of the first rectangularly-cut vinyl-coated flexible material proximate to one opposing edge of a first pair of the opposing edges of the first rectangularly-cut vinyl-coated flexible material and the second fastener element may be attached to the second surface of the first rectangularly-cut vinyl-coated flexible material proximate to a second opposing edge of the first pair of the opposing edges of the rectangularly-cut vinyl-coated flexible material.

As used herein, the term "or" may be construed in either an inclusive or exclusive sense. Moreover, the description of resources, operations, or structures in the singular shall not be read to exclude the plural. Conditional language, such as, among others, "can," "could," "might," or "may," unless specifically stated otherwise, or otherwise understood within the context as used, is generally intended to convey that certain embodiments include, while other embodiments do not include, certain features, elements and/or steps.

Terms and phrases used in this document, and variations thereof, unless otherwise expressly stated, should be construed as open ended as opposed to limiting. Adjectives such as "conventional," "traditional," "normal," "standard," "known," and terms of similar meaning should not be construed as limiting the item described to a given time period or to an item available as of a given time, but instead should be read to encompass conventional, traditional, normal, or standard technologies that may be available or known now or at any time in the future. The presence of broadening words and phrases such as "one or more," "at least," "but not limited to" or other like phrases in some instances shall not be read to mean that the narrower case is intended or required in instances where such broadening phrases may be absent.

What is claimed is:

1. A pool spring wrap configured to wrap around a pool spring of a pool cover system, comprising:

a rectangular member comprising a flexible material, defined by a perimeter comprising two pairs of opposing edges, and having a first surface and a second surface;

a first fastener element attached to the first surface of the rectangular member proximate to one opposing edge of a first pair of the opposing edges of the rectangular member; and a second fastener element attached to the second surface of the rectangular member proximate to a second opposing edge of the first pair of the opposing edges of the rectangular member;

wherein the first fastener element is removably engageable with the second fastener element when the pool spring wrap is wrapped around a pool spring coil; and wherein at least one of the opposing edges of the rectangular member is reinforced with a flexible material connected thereto.

2. The pool spring wrap of claim 1, wherein the flexible material of the rectangular member comprises vinyl coated polyester.

3. The pool spring wrap of claim 1, wherein the flexible material reinforcing the at least one of the opposing edges of the rectangular member comprises a polyester fabric connected thereto.

4. The pool spring wrap of claim 1, wherein the first fastener element and the second fastener element comprise a hook and loop material.

5. The pool spring wrap of claim 1, wherein the flexible material of the rectangular member comprises a material which is configured for use as a material of a pool cover for a pool cover system.

6. The pool spring wrap of claim 1, wherein the flexible material of the rectangular member comprises a water-resistant or waterproof material.

7. The pool spring wrap of claim 1, wherein first surface comprises a first texture and the second surface comprises a second texture, one of the first or second surfaces comprising a matte finish and the other of the first or second surfaces comprising a glossy finish.

8. The pool spring wrap of claim 1, wherein the flexible material of the rectangular member comprises a tarpaulin material, a canvas, a polyester material coated with polyurethane, or polyurethane.

9. The pool spring wrap of claim 1, wherein the pool spring wrap has a length at least as long as a length of the pool spring coil.

* * * * *